United States Patent [19]

Symon

[11] Patent Number: 4,928,896

[45] Date of Patent: May 29, 1990

[54] TRAVERSING APPARATUS FOR TRAVERSING A LONGITUDINALLY MOVING YARN WHICH IS TO BE WOUND UP THROUGHOUT A TRAVERSING STROKE

[75] Inventor: Georg Symon, Winterthur, Switzerland

[73] Assignee: Maschinenfabrik Rieter AG, Winterthur, Switzerland

[21] Appl. No.: 288,602

[22] Filed: Dec. 22, 1988

[30] Foreign Application Priority Data

Dec. 24, 1987 [CH] Switzerland ..... 05060/87

[51] Int. Cl.[5] ..... B65H 54/30

[52] U.S. Cl. ..... 242/43 R; 242/158 B

[58] Field of Search ..... 242/43 R, 43 A, 158 B

[56] References Cited

U.S. PATENT DOCUMENTS 3,333,782 8/1967 Beckwith et al. ..... 242/43 R
3,602,447 8/1971 Fisher et al. ..... 242/43 R

FOREIGN PATENT DOCUMENTS 642286 6/1962 Canada .
3444648 6/1985 Fed. Rep. of Germany .
1176068 1/1970 United Kingdom .
1205879 9/1970 United Kingdom .

*Primary Examiner*—Stanley N. Gilreath
*Attorney, Agent, or Firm*—Werner W. Kleeman

[57] ABSTRACT

A yarn guide member is driven by an entrainment member in a predetermined direction of movement of a belt run of a belt with which there is connected the entrainment member. In a stroke reversal zone the entrainment member is reversed in its movement by the belt moving around a reversing roller and there is thus released the yarn guide member from entraining engagement by the entrainment member. The yarn guide member, while then in so-to-speak free flight, strikes a housing wall operative as an impact wall. The yarn guide member thus changes its traversing direction. After having impacted the impact wall the yarn guide member returns to the entrainment vicinity of the entrainment member which in the meantime has begun its movement along the belt run now located opposite to the first mentioned belt run as the entrainment member rotates around the reversing roller. The impingement of the yarn guide member is taken up mechanically by the impact wall and thus does not affect the entrainment member, and the yarn also is positively guided at the reversal positions.

4 Claims, 3 Drawing Sheets

Fig. 4
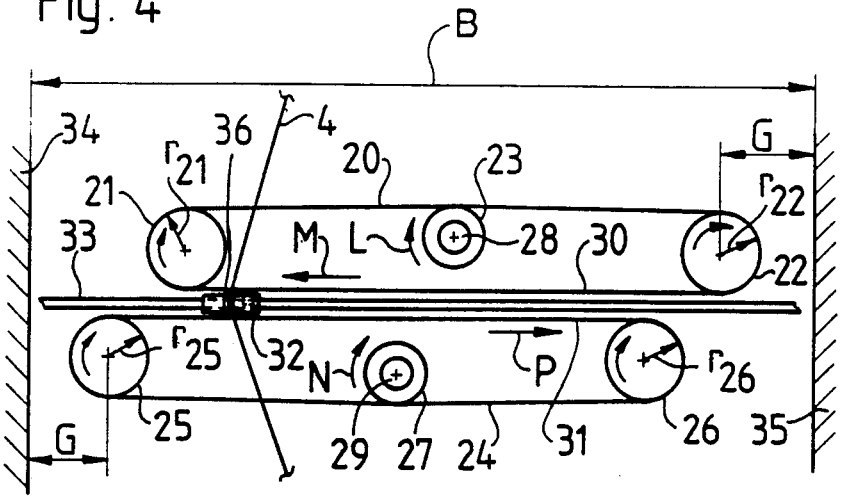
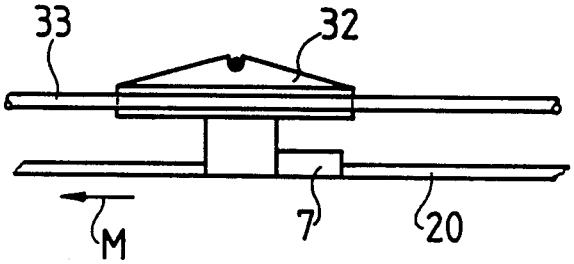
Fig. 4a
Fig. 6
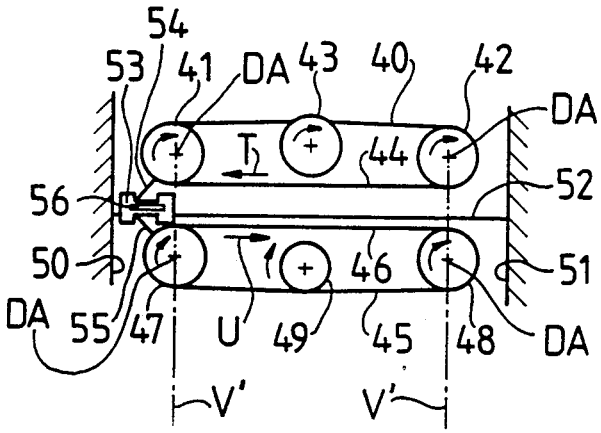

TRAVERSING APPARATUS FOR TRAVERSING A LONGITUDINALLY MOVING YARN WHICH IS TO BE WOUND UP THROUGHOUT A TRAVERSING STROKE

BACKGROUND OF THE INVENTION

The present invention relates to a new and improved traversing apparatus or traverser for traversing a longitudinally moving yarn or the like over a predetermined stroke length and which yarn or the like is to be wound or spooled.

In its more specific aspects, the yarn traversing apparatus of the present development is of the type comprising two counter-directionally or oppositely moving belt runs of at least one endless belt or belt member. The belt runs are guided substantially parallel to one another between stroke reversal zones or regions of the belt runs. The at least one endless belt is guided over reversing or deflection rollers or rolls so as to form the belt runs. The yarn is capable of being traversed or moved to-and fro in rapid alternation by an entrainment member provided on each such endless belt or belt member over an entrainment path of the stroke length along a yarn plane. There are also provided drive means for driving the at least one belt or belt member.

A heretofore known apparatus of the aforementioned type and as known, for example, from Canadian Patent No. 642,286, granted June 5, 1962, has entrainment members which are disposed on the belt or belt member and which directly guide the yarn. The belts, in other words, the rotational axes of the belt-reversing rollers, are offset from one another so that when the yarn is transferred from the yarn-guiding entrainment member in the stroke reversal zone, the yarn disengages from such entrainment member before being taken up by the oppositely moving entrainment member. During this step or operation the yarn oscillates freely in the air. This is disadvantageous because, for example, the direction of movement of the yarn ceases to be defined. In an apparatus of this type the duration of "standstill" of the yarn at its stroke reversal position must be adjusted if the yarn is to disengage rapidly and be taken up rapidly by the oppositely moving entrainment member and if the duration of the standstill and, therefore, edge thickening of the yarn are to be reduced to a minimum. In the prior art apparatus the yarn abuts or strikes the taking-over entrainment member during yarn transfer and therefore experiences locally excessive and thus undesirable loads or stresses.

SUMMARY OF THE INVENTION

Therefore with the foregoing in mind it is a primary object of the present invention to provide a new and improved construction of a traversing apparatus or traverser which is not afflicted with the aforementioned shortcomings and drawbacks.

Another and more specific object of the present invention aims at the provision of a new and improved construction of a yarn traversing apparatus of the character described which is intended to substantially obviate wear of the entrainment member on the belt, to provide positive guidance of the yarn at the stroke reversal positions and enable reversal of the yarn at such stroke reversal positions, thus reducing edge thickening of the yarn without an excessive increase in yarn tension in the stroke reversal zones or regions.

Now in order to implement these and still further objects of the invention, which will become more readily apparent as the description proceeds, each belt or belt member has at least one entrainment member. A yarn guide or carrier member is provided for the yarn and this yarn guide or carrier member is guided in a yarn plane and is movable therealong by means of the at least one entrainment member in the at least one traversing direction. In each stroke reversal zone an impact wall is disposed separately from the at least one entrainment member to intercept the yarn guide or carrier member, this yarn guide or carrier member disengaging from entrainment by the driving entrainment member in the stroke reversal zones and impacting or striking the associated impact wall in so-to-speak free flight. The yarn guide or carrier member thus changes its traversing direction and is driven by the oppositely moving entrainment member only after impacting or striking the associated or related impact wall.

The traversing apparatus or traverser according to the present invention has the advantage not only of ensuring rapid reversal of the yarn guide or carrier member and therefore of the yarn or the like but also mechanical absorption of the impingement action of the yarn guide or carrier member by the impact wall. As a result, there is avoided impingement of the entrainment member at the impact wall, and the yarn also is positively guided at its reveral positions.

Moreover, with the traversing apparatus or traverser constructed according to the present invention and specifically in accordance with a further advantageous embodiment thereof, there can be provided two belts or belt members and a total of at least two counter-directionally or oppositely moving entrainment members. In other words, each belt can have at least one entrainment member. The yarn guide or carrier member can then be traversed alternately back-and-forth by one or the other entrainment member, and it is possible for the yarn guide or carrier member to be transferred from one entrainment member to the oppositely moving entrainment member in the stroke reversal zones or regions.

In another embodiment of the present invention the yarn guide or carrier member can be, however, driven by the same entrainment member in both traversing directions.

Advantageously, the yarn guide or carrier member is preferably guided in a guide means or guide element substantially parallel to the belt runs. The reversing or deflection roller of one belt releasing the yarn guide or carrier member can be set back or retracted, as considered in the traversing direction relative to the reversing or deflection roller of the other belt and which takes over the yarn guide or carrier member and viewed in relation to the impact wall or wall member.

The yarn guide or carrier member can have two guide surfaces for the entrainment member and two impact surfaces adapted to strike or impact the impact or abutment walls.

Preferably, the stroke length extends substantially parallel to the rotational axis of a yarn take-up spool or bobbin in those cases in which the traversing apparatus or traverser is contemplated, for example, to wind-up the yarn or the like. In an embodiment having two belts or belt members, the rotational axes of the reversing rollers or rolls of one belt are, as considered in the stroke direction, preferably offset relative to the reversing rollers of the other belt, so that the disengagement of the travelling element, that is, the yarn guide member from the entrainment member can be accomplished in an advantageous manner. In this case, the reversing roller for the entrainment member releasing the yarn guide member is preferably disposed within the distance between the two impact or abutment walls or members.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 4 is a diagrammatic side elevation of another embodiment of a traversing apparatus or traverser for traversing a longitudinally moving yarn or the like over a predetermined stroke length;

FIG. 4*a* is a diagrammatic view of a part of the embodiment depicted in FIG. 4;

FIG. 6 is a diagrammatic elevational view of another embodiment of a traversing apparatus or traverser for traversing a longitudinally moving or travelling yarn or the like over a predetermined stroke length.

DETAILED DESCRIPTION OF THE PREFERRED EMBODIMENTS

Describing now the drawings, it is to be understood that to simplify the showing thereof, only enough of the traversing apparatus or traverser for traversing a longitudinally moving or travelling yarn or the like over a predetermined stroke length has been illustrated therein as is needed to enable one skilled in the art to readily understand the underlying principles and concepts of this invention. It is here further noted and thus to be understood that the term "yarn" is used in this description in a broader sense to not only denote yarns as such but equally encompasses threads, filaments and filamentary-like materials or the like.

Figure 1:
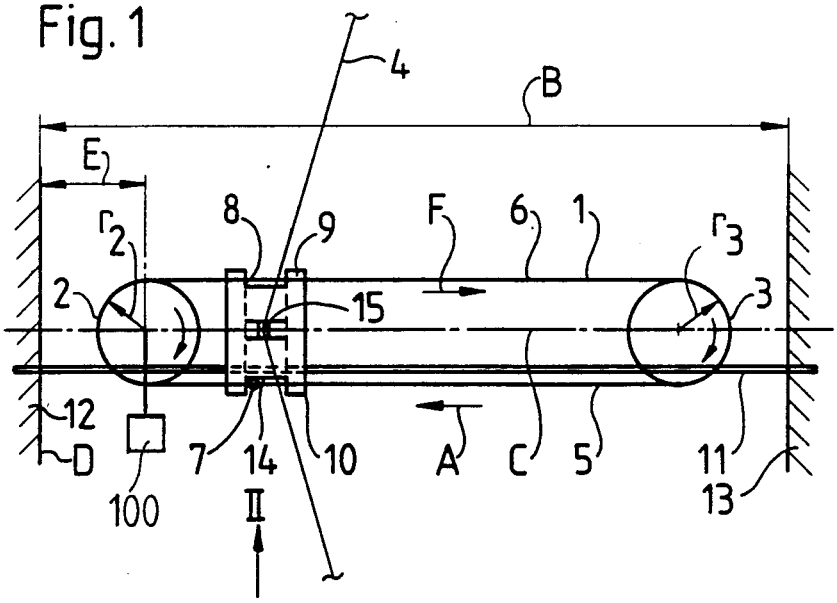
FIG. 1 is a diagrammatic view in side elevation of a first embodiment of a traversing apparatus or traverser for traversing a longitudinally moving or travelling yarn or the like over a predetermined stroke length.

Turning attention now specifically to FIG. 1 of the drawings, an endless belt or belt member 1 or equivalent structure travels over reversing or deflection rollers or rolls 2 and 3 each having the same radius $r_2$ and $r_3$. Either the reversing or deflection roller 2 or the reversing or deflection roller 3 can be appropriately driven by any suitable drive or drive motor, as generally indicated by the drive motor 100. The belt or belt member 1 here moves in the direction A. The reversing or deflection rollers 2 and 3 are disposed in a stroke o traversing zone or region B within which it is required to traverse or move back-and-forth a yarn 4 or the like which travels or moves along a yarn plane C and is required to be spooled-up or wound in a manner as is well known in the yarn or filament winding art. The belt runs 5 and 6 of the travelling belt 1 are disposed between the reversing or deflection rollers 2 and 3, in other words, within the stroke or traversing zone B. An entrainment member 7 on the belt 1 engages a guide or entrainable surface 8 of a yarn guide or carrier member 10 disposed on a guide element here shown as a guide rail or rail member 11 extending as far as housing or casing walls 12 and 13 defining impact or abutment walls. The guide or entrainable surface 8 and another guide or entrainable surface 9 are formed in the yarn guide or carrier member 10 by the provision of a suitable recess or cutout 14. The yarn 4 extends through an eye or guide eyelet 15 or equivalent structure provided at the yarn guide or carrier member 10.

The reversing or deflection rollers 2 and 3 are each disposed at a related stroke reversal zone or region E. When the travelling or movable belt 1 is driven then the entrainment member 7 moves the yarn guide or carrier member 10 in the direction A corresponding to the direction of movement of the belt run 5. The entrainment member 7 is deflected in the stroke reversal zone E by the belt 1 moving around the corresponding reversing or deflection roller 2 and thus releases the yarn guide or carrier member 10 which then in so-to-speak free flight impacts or strikes the related housing wall 12 and which, as stated, is effective as an impact or abutment wall. At the stroke reversal position, denoted by an impingement plane D of the impact or abutment wall 12, the yarn guide or carrier member 10 reverses its traversing direction and after impacting or striking against the impact wall 12 returns to a position near the entrainment member 7, in other words, to a position where it can be positively entrained by such entrainment member 7. In the meantime the entrainment member 7 has begun its movement on the belt run 6 as it rotates around the related reversing or deflection roller 2. The entrainment member 7 can engage the yarn guide or entrainable surface 9 and thus can now drive the yarn guide or carrier member 10 in the direction indicated by arrow F. The other or oppositely situated housing wall or impact or abutment wall 13 has a similar impingement plane D and when there is reached the oppositely situated stroke reversal zone E associated with the other impact or abutment wall 13, then the yarn guide or carrier member 10 again moves in so-to-speak free flight after its release by the entrainment member 7 and impacts this impact wall 13 and the entrainment member 7 entrainably re-engages with the guide surface 8. The yarn guide or carrier member 10 and, therefore, the yarn 4 are traversed in this way in a continuous alternation or traversing sequence over the stroke or traversing zone or region B.

Figure 3:
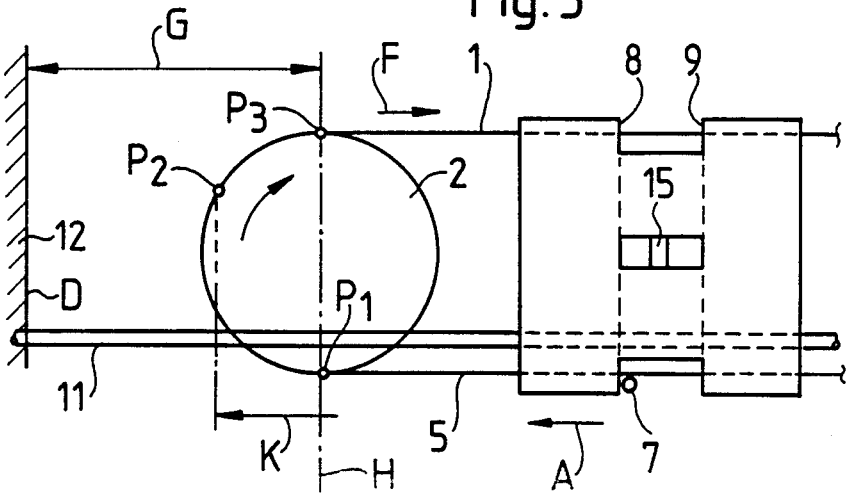
FIG. 3 is a diagrammatic elevational view of a part of the exemplary embodiment shown in FIGS. 1 and 2 on an enlarged scale.

As the enlarged detail view of FIG. 3 also shows, the impingement plane D of the impact wall 12 is disposed at a distance G from the center plane H of the associated reversing or deflection roller 2 at which, as viewed in the belt run travel direction F, the entrainment member 7 engages the yarn guide or carrier member 10 at the position $P_3$. It is assumed in this case that the entrainment member 7 entrainably disengages from the yarn guide or carrier member 10 at the position $P_1$ and entrainably re-engages with the yarn guide or carrier member 10, for example, at a position between the positions $P_2$ and $P_3$ or at the position $P_3$ as it moves around the reversing or deflection roller 2. The distance G depends, for example, upon the distance K between the entrainment member 7 and the center plane H in the position at which the entrainment member 7 re-engages with the yarn guide or carrier member 10 between the positions $P_2$ and $P_3$.

Figure 2:
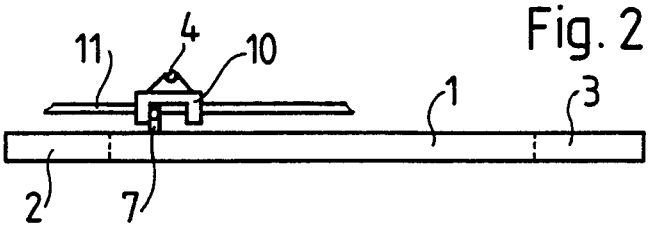
FIG. 2 is a view of the traversing apparatus or traverser of FIG. 1 generally looking in the direction of the arrow II thereof.

In the modified embodiment which is depicted in FIG. 4 and in which the same or analogous components or parts as shown and described heretofore with reference to FIGS. 1 to 3 have been generally designated with the same reference characters, an endless belt or belt member 20 travels or runs over reversing or deflection rollers 21 and 22 which have the same radii $r_{21}$ and $r_{22}$, respectively, and also travels over a belt guiding roller 23. Moreover, an endless belt or belt member 24 travels or runs over reversing or deflection rollers 25 and 26 which have the same radii $r_{25}$ and $r_{26}$, respectively, and also travels over a belt guiding roller or roll 27. The belt guiding rollers 23 and 27 can be driven by a respective driving roller 28 and 29.

The driving roller 28, which rotates in the direction indicated by arrow L, drives the belt 20 such that one belt run 30 thereof moves in the direction indicated by arrow M. The driving roller 29, which rotates in the direction indicated by arrow N, drives the belt 24 such that one belt run 31 thereof moves in a direction P counter-directional or opposite to the direction M. The belt runs 30 and 31 are disposed opposite one another. Disposed on each belt or belt member 20 and 24 is an entrainment member 7 which can engage guide or entrainable surfaces 32*a* and 32*b* (see FIG. 5) of a yarn guide or carrier member 32 and traverse or reciprocate the same in the direction M or P over the stroke traversing zone or region B. The yarn guide or carrier member 32 is disposed on a guide element here shown as a rail 33 disposed between impact or abutment walls or impact members 34 and 35. The yarn 4 or the like moves through an eye or guide eyelet 36 or equivalent structure of the yarn guide or carrier member 32 and is traversed over the stroke traversing zone B by the traversing movement of the yarn guide or carrier member 32.

Figure 5:
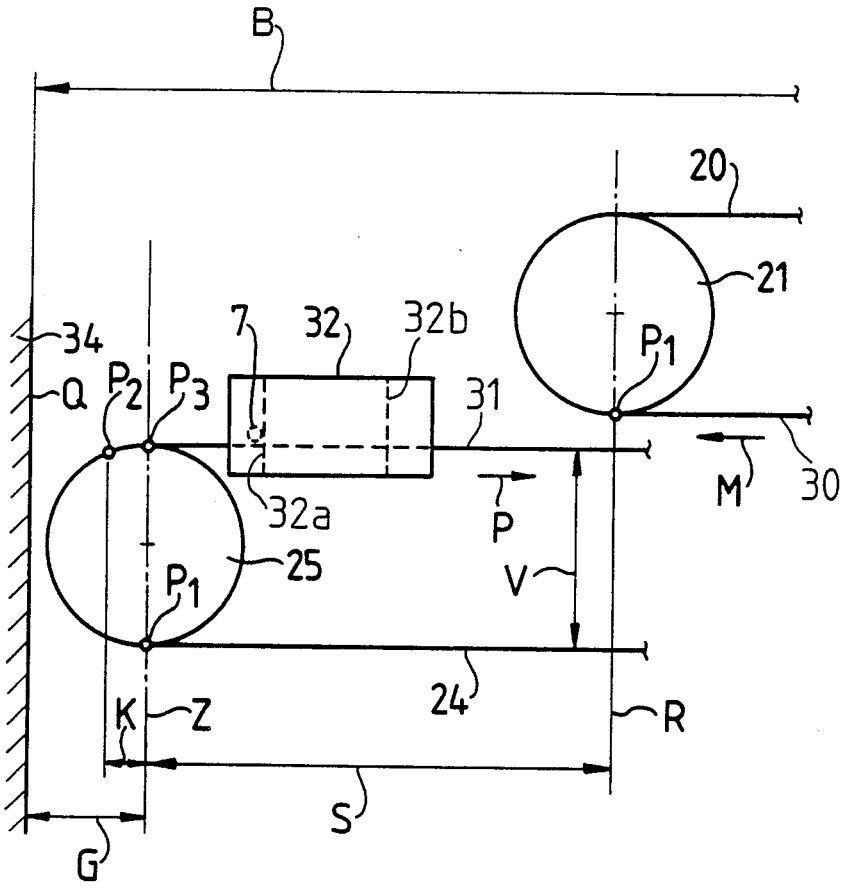
FIG. 5 is a diagrammatic enlarged view of another part or portion of the embodiment shown in FIG. 4.

As best seen by referring to FIG. 5, an impingement plane Q of the impact wall 34 is disposed at a distance G from the center plane Z of the related reversing or deflection roller 25 which takes over the yarn guide or carrier member 32, the parameters of which can be as hereinbefore described. The distance between the impact wall 34 and the center plane of the reversing or deflection roller 25 can be determined in the same way as heretofore discussed.

The reversing or deflection roller 21 around which the entrainment member 7 moves upon release of the yarn guide or carrier member 32, that is, the reversing or deflection roller 21 releasing or delivering the yarn guide or carrier member 32, has its center plane R disposed at a distance S from the center plane Z of the reversing or deflection roller 25. The distance S depends, for example, upon the diameter V of the path travelled by the yarn guide or carrier member 32 around the reversing or deflection roller 25 and upon the distance K between the take-over position of the entrainment member 7 and the center plane Z of the reversing or deflection roller 25.

As also shown in the modified embodiment of FIG. 6, a belt or belt member 40 can travel over two reversing or deflection rollers 41 and 42 and can be driven by a driving roller 43 such that belt run 44 moves in direction T. Another belt or belt member 45 is disposed such that its belt run 46 is located opposite and substantially parallel to the belt run 44 of the belt or belt member 40. The belt or belt member 45 travels or runs over reversing or deflection rollers 47 and 48 and is driven by a driving roller 49 so that its belt run 46 moves in a direction U directed opposite to the movement direction T of the belt run 44. As explained previously, reversing or deflection rollers 41 and 42 and 47 and 48 are disposed between two housing walls or wall members 50 and 51 defining impact or abutment walls and between which extends a guide rail 52 for a yarn guide or carrier member 53. The rotational axis DA of the reversing or deflection rollers 41, 47 and 42, 48 are respectively disposed opposite one another in a plane V'. An entrainment member 54 on the belt 40 and a entrainment member 55 on the other belt 45 reciprocate the yarn guide or carrier member 53, as in the embodiments hereinbefore described, in a stroke reversal zone between the housing walls or impact walls 50 and 51. A yarn (here not shown) extending through an eye or guide eyelet 56 or equivalent structure of the yarn guide or carrier member 53 can therefore be traversed or reciprocated over the stroke zone or region. As similarly described in the previous embodiments, the yarn guide or carrier member 53 disengages from the entrainment members 54 and 55 in the stroke reversal zones and then in so-to-speak free flight can impact or abut against the impact or abutment members defined by the housing walls 50 and 51.

By way of completion it is noted that in this arrangement the events or operations which take place in the stroke reversal zones and at the stroke reversal positions, and the arrangement of the impact or abutment walls or surfaces, can occur or be accomplished as in the manner heretofore described for the previously discussed exemplary embodiments.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A traversing apparatus for traversing a longitudinally moving yarn over a predetermined stroke length, comprising:

two counter-directionally moving travelling endless belts each containing two counter-directionally moving belt runs;

means for guiding the two counter-directionally moving belt runs of each of the two counter-directionally moving travelling endless belts substantially parallel to one another between stroke reversal zones of said predetermined stroke length;

said guiding means comprising for each associated counter-directionally moving travelling endless belt reversing rollers over which there is guided the associated counter-directionally moving travelling endless belt to form the two counter-directionally moving belt runs of the associated counter-directionally moving travelling endless belt;

two entrainment members defining a respective entrainment member provided for each of said two counter-directionally moving travelling endless belts for traversing the yarn in alternation in successive opposite traversing directions over an entrainment path of the predetermined stroke length along a yarn plane;

drive means for driving the two counter-directionally moving travelling endless belts;

said two counter-directionally moving travelling endless belts being provided with a yarn guide member for the yarn;

said yarn guide member being guided along the yarn plane and being movable therealong by means of one respective entrainment member of the two entrainment members of one of the two counter directionally moving travelling endless belts in one of the successive opposite traversing directions and by means of the other respective entrainment member of the two entrainment members of the other one of the two counter directionally moving travelling endless belts in an opposite one of the successive opposite traversing directions;

said predetermined stroke length including a respective stroke reversal zone at opposite end regions of said predetermined stroke length;

means defining an impact wall provided at each stroke reversal zone;

each said impact wall being disposed separately from the two entrainment members to intercept the yarn guide member; and said yarn guide member disengaging from entrainment by an associated one of the two entrainment members in each of the stroke reversal zones and impacting against an associated one of the impact walls in free flight and changing its traversing direction and being entrainably driven in an opposite traversing direction by the other associated one of the two entrainment members only after impacting against the associated impact wall.

2. A traversing apparatus for traversing a longitudinally moving yarn over a predetermined stroke length, comprising:

two travelling endless belts each containing two counter-directionally moving belt runs;

means for guiding the two counter-directionally moving belt runs of each of the two travelling endless belts substantially parallel to one another between stroke reversal zones of said predetermined stroke length;

said guiding means comprising for each associated travelling belt reversing rollers over which there is guided the associated travelling endless belt to form the two counter-directionally moving belt runs of the associated travelling belt;

two entrainment members defining a respective entrainment member provided for each of said two travelling endless belts for traversing the yarn in alteration in successive opposite traversing directions over an entrainment path of the predetermined stroke length along a yarn plane;

drive means for driving the two travelling endless belts;

said travelling endless belts being provided with a yarn guide member for the yarn;

said yarn guide member being guided along the yarn plane and being movable therealong by means of one respective entrainment member of the two entrainment members of one of the two traveling endless belts in at least one of the successive opposite traversing directions and by means of the other respective entrainment member of the two entrainment members of the other one of the two travelling endless belts in an opposite one of the successive opposite traversing directions;

said predetermined stroke length including a respective stroke reversal zone at opposite end regions of said predetermined stroke length;

means defining an impact wall provided at each stroke reversal zone;

each said impact wall being disposed separately from the two entrainment members to intercept the yarn guide member;

said yarn guide member disengaging from entrainment by an associated one of the two entrainment members in each of the stroke reversal zones and impacting against an associated one of the impact walls in free flight and changing its traversing direction and being entrainably driven in an opposite traversing direction by the other counter-directionally moving associated one of the two entrainment members only after impacting against the associated impact wall; and the yarn guide member being transferred from one entrainment member to the other counter-directionally moving entrainment member in the stroke reversal zones.

3. The traversing apparatus as defined in claim 2, wherein:

reversing rollers are provided for each of the two belts;

each of said reversing rollers having a rotational axis;

the rotational axes of the reversing rollers of one belt, as considered in the traversing directions, being offset relative to the reversing rollers of the other belt.

4. The traversing apparatus as defined in claim 3, wherein:

one of the reversing rollers of one of the belts defines a reversing roller for releasing the yarn guide member;

one of the reversing rollers of the other belt defining a reversing roller for taking up the yarn guide member released from the one belt; and the one reversing roller of the one belt which defines said releasing reversing roller being set back, as considered in the traversing directions, with respect to the one reversing roller of the other belt which defines said taking up reversing roller.

* * * * *